US008819872B2

(12) United States Patent
Bradley et al.

(10) Patent No.: US 8,819,872 B2
(45) Date of Patent: Sep. 2, 2014

(54) PLUMBING PIPE AND GARBAGE DISPOSAL SANITIZER AND DEODORIZER

(75) Inventors: Joshua Bradley, Albuquerque, NM (US); Gregory Goldsand, Scottsdale, AZ (US); Reinhold Franz Wirth, Sandia Park, NM (US)

(73) Assignee: Odor and Out LLC, Albuquerque, NM (US)

( * ) Notice: Subject to any disclaimer, the term of this patent is extended or adjusted under 35 U.S.C. 154(b) by 541 days.

(21) Appl. No.: 13/052,328

(22) Filed: Mar. 21, 2011

(65) Prior Publication Data

US 2012/0126045 A1 May 24, 2012

Related U.S. Application Data

(60) Provisional application No. 61/458,125, filed on Nov. 18, 2010.

(51) Int. Cl.

| | |
|---|---|
| ***E03D 9/02*** | (2006.01) |
| ***E03C 1/126*** | (2006.01) |
| *E03C 1/184* | (2006.01) |
| *E03C 1/266* | (2006.01) |

(52) U.S. Cl.

CPC ..... *E03C 1/126* (2013.01); *E03C 1/184* (2013.01); *E03C 1/266* (2013.01)

USPC ..... 4/222; 241/46.013

(58) Field of Classification Search

USPC ..... 222/402.13, 402.14, 402.1, 402.15, 222/402.22, 402.23, 402.11, 402.12, 182, 222/373, 378, 372; 4/220, 222; 138/120, 138/116, 117; 285/25

See application file for complete search history.

(56) References Cited

U.S. PATENT DOCUMENTS

| | | | | |
|---|---|---|---|---|
| 4,910,808 | A | 3/1990 | Roth | |
| 5,249,749 | A | 10/1993 | Krebsbach | |
| 5,577,673 | A | 11/1996 | Donaghey | |
| 5,940,894 | A * | 8/1999 | Cruz | 4/222 |
| 8,220,667 | B1 * | 7/2012 | Butcher et al. | 222/196 |
| 2006/0076366 | A1 * | 4/2006 | Furner et al. | 222/402.13 |

* cited by examiner

*Primary Examiner* — Huyen Le
*Assistant Examiner* — Janie Christiansen
(74) *Attorney, Agent, or Firm* — Lisa Foundation Patent Law Clinic—Arizona State University

(57) ABSTRACT

There is provided a disinfectant/deodorizer apparatus capable of disinfecting and/or deodorizing garbage disposals and other effluent pipes and drains through an automated process that will be activated through an electronic timer on a circuit board. The circuit board activates a motor that will turn and push on an actuator that forces the disinfectant/deodorizer canister up, forcing the tip to depress into a hole in the top end receiver of the apparatus, which will receive the material substance in a small diameter tubing that ends into an opening on a garbage disposal, or an effluent pipe or drain, thus causing disinfecting and/or deodorizing of said piping or appliance.

16 Claims, 5 Drawing Sheets

PLUMBING PIPE AND GARBAGE DISPOSAL SANITIZER AND DEODORIZER

CROSS REFERENCE TO RELATED APPLICATIONS

This application claims priority to US Provisional Application 61/458,425 filed on Nov. 18, 2010.

FIELD OF INVENTION

The present invention relates to an automated apparatus that can help disinfect and/or deodorize garbage disposals, drains, or any other plumbing effluent pipes. The device is operated by either battery or electrical outlet, which then activates a motor which acts to depress a canister to release a deodorizer, disinfectant, chemical, water, treatment solution or other type of fluid or gas into a disposal, drain pipe, or any effluent pipe.

BACKGROUND OF THE INVENTION

The occurrence of bacteria and odor is quite prevalent in effluent pipes, drains, and garbage disposals. The current methods of decreasing or eliminating the proliferation of bacteria, and the odors related to these bacterium, are quite cumbersome and/or time consuming ventures to alleviate. The process to eliminate the named issues are often aimed at the odor alone and not the root or cause of the problem, the bacteria. A common solution are home remedies, such as ice cubes, lemons, or another citrus; which alone do not solve the issue; however, create a temporary pleasant odor. A primary concern for the average commercial or residential effluent piping, drain, or disposal is to address the unpleasant odor and not focus on the bacteria proliferation, which is the cause of the foul odors. The current process to alleviate the odor are quite labor intensive and must be treated daily, weekly, or monthly on effluent pipes, drains, and/or garbage disposals to minimize odor. When a commercial or residential consumer uses purchased chemicals to decrease odor, they are often exposed to hazardous compositions that may cause harm or dangerous interactions to the user.

U.S. Pat. No. 5,249,749 is a self-cleaning garbage disposal that utilizes a spray ring which is located below the splash guard. A control valve is connected to the cold water pipe and controls the flow of water from the cold water line into the spray ring. The control valve is engaged simultaneously with the disposal when the disposal is activated, which also initiates a timer control circuit on the control valve. The spray ring, using standard water pressure, forces the food debris directly into the disposal blades in a counterclockwise direction for faster and more efficient grinding of food debris. When the disposal is switched off, water continues to flow through the spray ring for approximately fifteen seconds, thoroughly flushing any remaining debris down the drain. This equipment is limited to the flushing of the garbage disposal to make sure the food particles are flushed down into the drain; but this does not address the cause of foul smelling odors, the proliferation of bacteria. While most of the food particles will be washed down the drain, bacteria growth still will occur causing foul odors. This device is quite limited to garbage disposals and not to all effluent pipes and drains. Another issue is that this invention is quite labor intensive to install and not all individuals would be able to install the device. A hole must be drilled into the spray ring which necessitates the proper tools for installation. A separate cold line pipe must be split for this invention, which further complicates installation and validates the need for a plumber or handyman to install the device.

U.S. Pat. No. 4,910,808 is directed to a dispenser for dispensing sanitizer and/or deodorizer chemical from a pressurized container into the inside of a grinder type garbage disposer. The dispensing device mounts in a convenient location adjacent to the grinding garbage disposer it is intended to serve. The location must also be ideal for the person who uses the garbage disposer. The device comprises of a canister with a substantially closed bottom surface and a hollow inner area enclosed by a selectively and translatable removable lid. A small diameter tube extends from the nozzle of a pressurized container of deodorant through a small opening in the substantially closed bottom into an area below the mouth of the grinder garbage disposer. For activation of the device, the top is translated downward against the valve of the pressurized container causing the device to sanitize and/or deodorize a chemical to escape in to the container flow through the small diameter tube into the garbage disposer. Thus, the disposal is sanitized and/or deodorized. This method is limited to manual activation of the sanitizer/deodorizer. There is not an automated process for which this application may be deployed; it is solely a manual release of the disinfectant/deodorizer. A small opening must be created into the base of the sink; requiring specialized tools, and thus requiring the need for a handyman or a plumber in most situations. The canister application of the invention is sitting on the sink which creates a cumbersome and unattractive look on the sink top and counter area. This device is limited to garbage disposals and not all effluent pipes and drains in plumbing applications.

U.S. Pat. No. 5,577,673 is a deodorizer apparatus for an electric grinder type garbage disposal system that automatically injects a spray of deodorizer from a conventional spray can into the grinder chamber of a disposal, after the grinder motor is turned off, which is optimum time for deodorizing. One type of actuator mechanism uses a shaft supported cam to depress the valve on the spray can. The cam is driven against a rest stop by a spring, and the spring is tensioned by a motor device operated parallel with the grinder motor when the disposer is active. Another actuator mechanism uses a solenoid operated by logic circuits sensing the state of the grinder motor. This device is limited to use only when the disposal unit is activated. If the garbage disposal is not activated in weeks, the device will not deodorize and thus the smells will accumulate. Because the device is activated by the motor of the disposal, the invention must be tied into the motor of the disposal. This will most likely have a need for a handyman or plumber to install said device. More evidence of the difficulty to install the invention is that this device must be installed by method of an opening made in the neck, more specifically to a fitting arranged in the neck, which cannot be handled by the average homeowner. This invention is limited to a garbage disposal and not effluent pipes and drains.

Due to the problems and issues addressed herein and in other prior art devices, there is a great need to improve upon them.

SUMMARY OF INVENTION

This invention is a novel and innovative method of killing bacteria and/or deodorizing smells in garbage disposals, effluent pipes and drains. To accomplish this task, a dispensing container is assembled into the plumbing, either in-line between two pipes, into a drain assembly, into the dishwasher drain on the garbage disposal or any effluent pipe. The apparatus injects directly into the pipe, drain or garbage disposal. Most disposal units are fitted with dishwasher drain connections which is optimal placement for device due to ease of installation and it is directly before the grinding wheels of the disposal unit where most of the debris can begin to create an undesirable odor. This device would slip into the disposals dishwasher inlet access and the dishwasher drain line would plug into the opposite end of the device or in absence of a dishwasher, a knock-out would be in disposal side of apparatus. When installing in a effluent pipe setting, the device would be installed in-line between the two pipes, optimally before where bacteria proliferates. The dispensing canister is connected to a circular seating that is affixed inside the invention. The dispensing unit is a pressurized system, through an aerosol can, that is timed through the use of simple electronics and mechanical mechanisms to dispense a desired dosage at a predetermined time. The dispensing canister would be fastened in such a manner that it would allow for easy installation and easy examination of the fluid level. In its final embodiment the liquid would be available in a sealed container that will fit into place on the dispensing unit and be ready for usage.

BRIEF DESCRIPTION OF THE DRAWINGS

A fuller understanding of the foregoing may be had by reference to the accompanying drawings, wherein.

DETAILED DESCRIPTION OF THE INVENTION

Figure 1A:
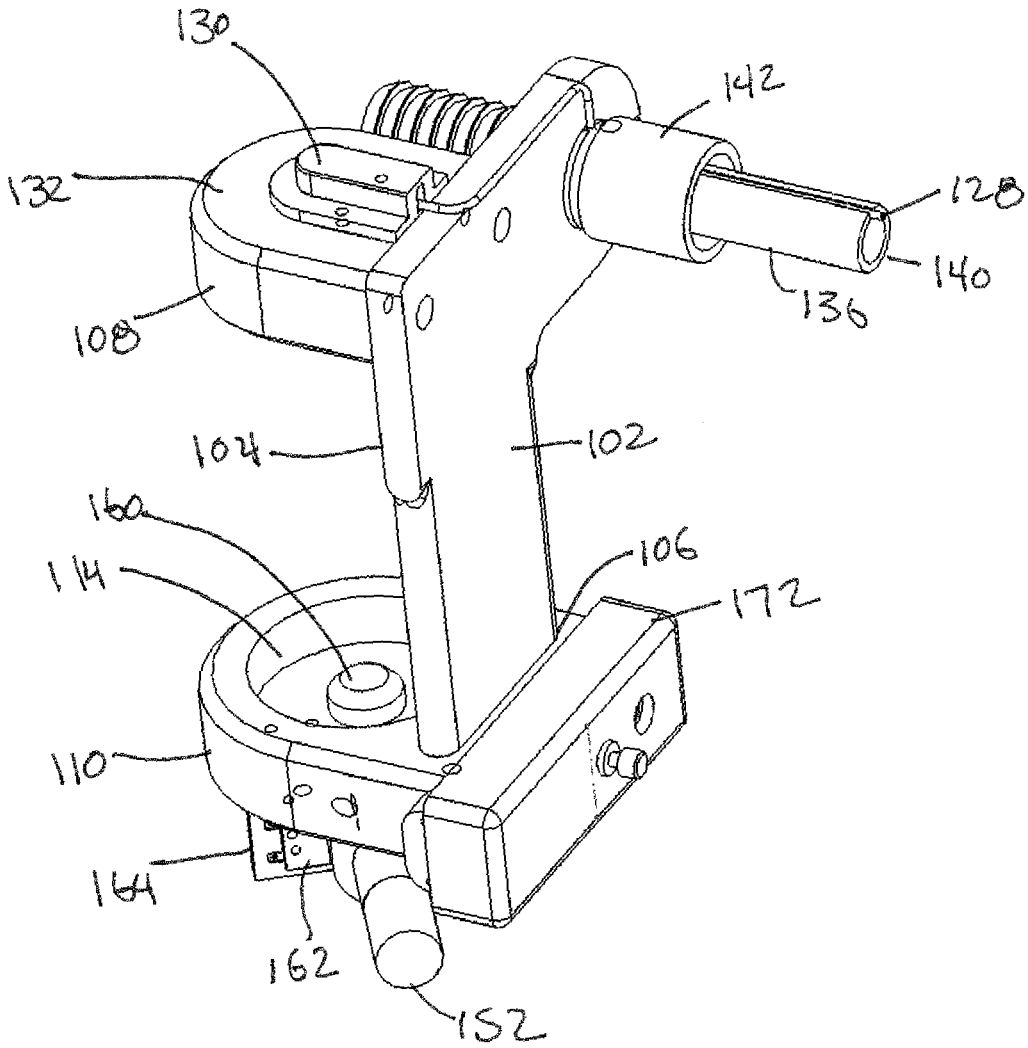
FIG. 1A is a perspective view of an apparatus that disinfects and deodorizes garbage disposals, drains, or any other plumbing effluent pipes.
Figure 1B:
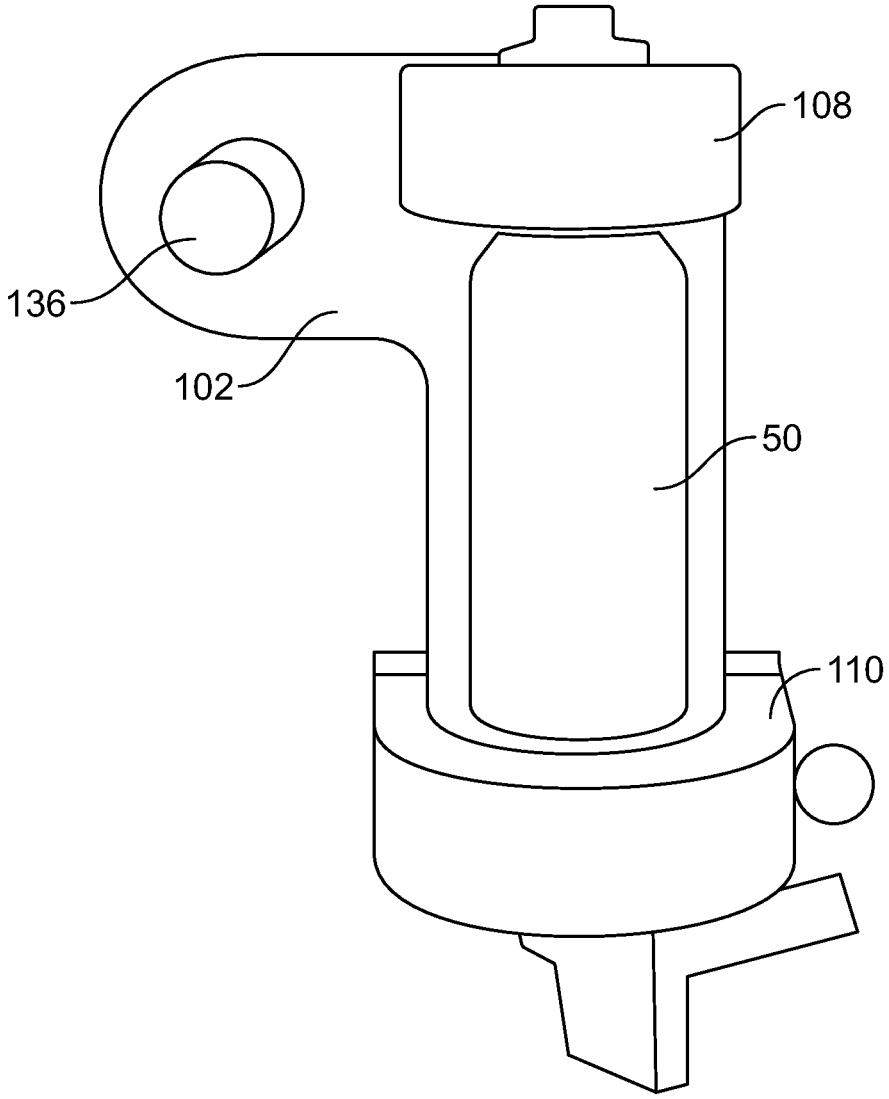
FIG. 1B is a front view of an apparatus that disinfects and deodorizes garbage disposals, drains, or any other plumbing effluent pipes showing the aerosol canister.
Figure 2:
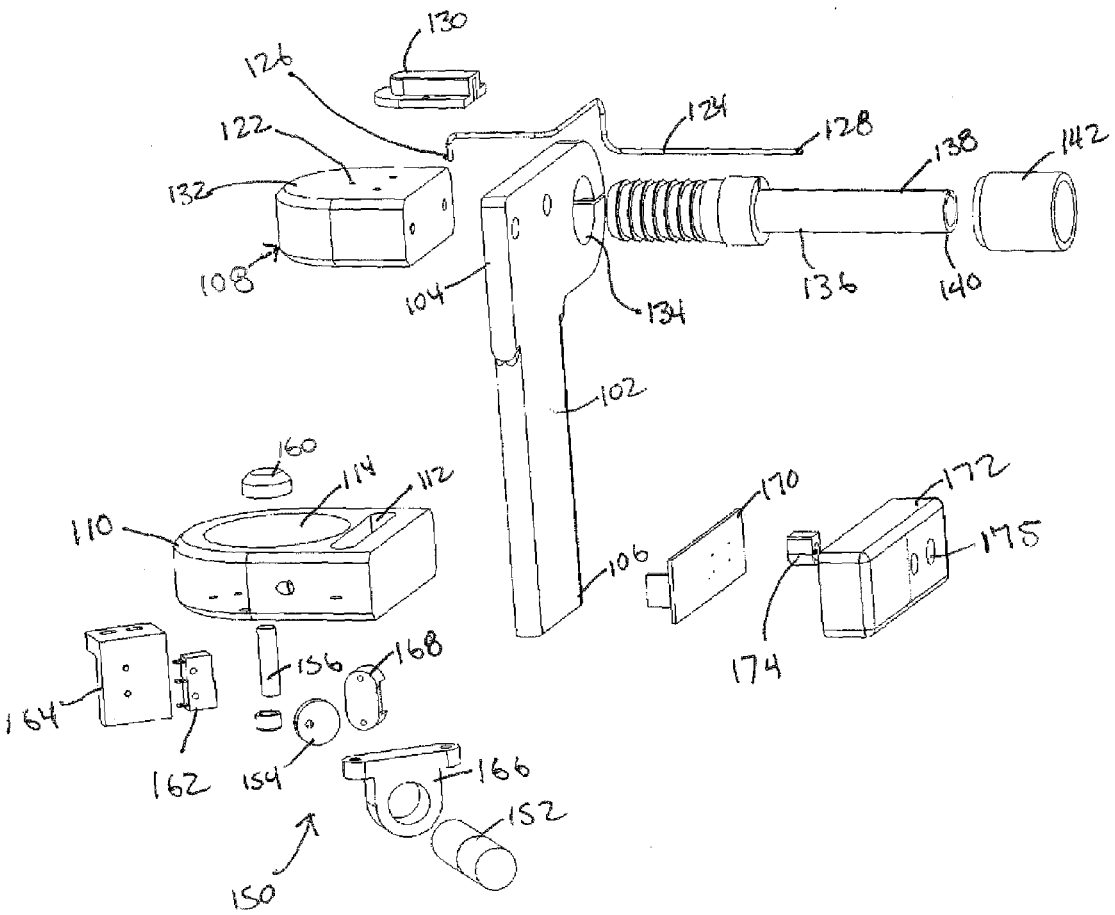
FIG. 2 is an exploded view of FIG. 1A.
Figure 3B:
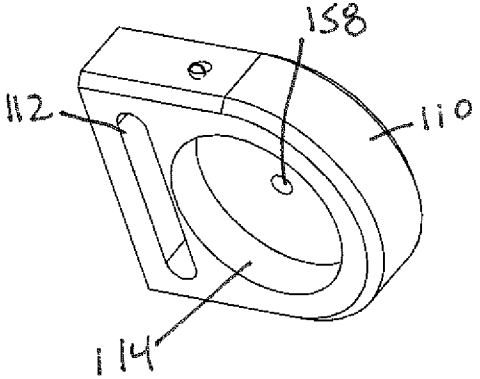
FIG. 3B is a perspective side view of the base canister support member incorporated into FIG. 1.
Figure 3A:
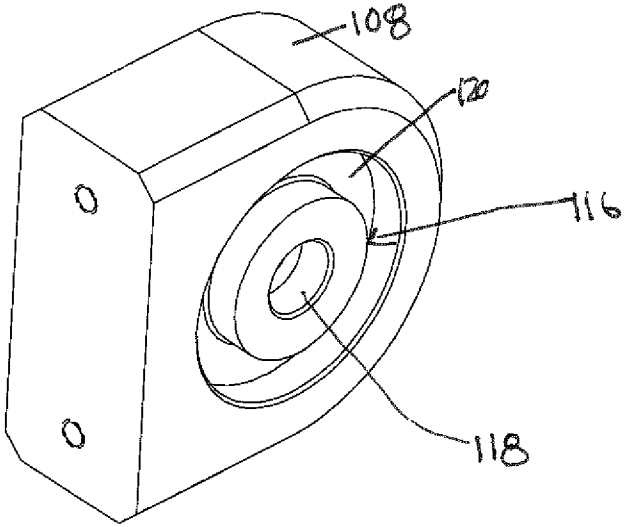
FIG. 3A is a perspective side view of the top canister support member incorporated into FIG. 1.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Referring now to FIGS. 1-3*b*, there is shown an apparatus 100 that can be employed to disinfect and/or deodorize garbage disposals, drains, toilets, or any other plumbing effluent pipes. The apparatus 100 is operated by either battery or electrical outlet that when activated is set to release a deodorizer, disinfectant, chemical, water, treatment solution or generally any type of pressurized fluid or gas from a canister into the disposal, drain pipe, or any effluent pipe.

The apparatus 100 includes a body element 102 that has an upper portion 104 and a lower portion 106 that are secured to a top canister support member 108 and a base canister support member 110, respectively. The top canister support member 108 is fastened to the upper portion 104 of the body element 102 such that the top canister support member 108 extends outwardly from the body element 102. The base canister support member 110 includes a slot 112 that is sized to receive the lower portion 106 of the body element 102. A screw or other fastening member is then set to secure the lower portion 106 within the slot 112. As with the top canister support member 108, the base canister support member 110 is fastened such that a lower canister support region 114 extends outwardly from the body element 102 at a position that aligns with an upper canister support region 116 defined in the top canister support member 110. Whereby when secured a canister can be secured or held in place between the top and base canister support members 108 and 110.

The upper canister support region 116 includes inner and outer annular indentations 118 and 120, respectively, to help hold and support the top of the aerosol canister 50. In addition, an aperture 122 is provided at the center of the inner indentation 118 to coincide with the valve opening of the aerosol canister. However, if the valve opening of the canister is moved or different the aperture 122 can be re-designed to coincide with the correct valve opening.

A delivery tube 124 is provided to deliver a deodorizer, disinfectant, water, treatment solution or other type of fluid and/or gas aerosol or chemical (generally referred to and defined as a "material substance") from the canister into the disposal, drain, or any other plumbing effluent pipe. The delivery tube 124 includes a first entry end 126 angled into the aperture 122 and will be in communication with the valve opening of the canister. A second exit end 128 of the delivery tube 124 will then be angled or positioned for access into the disposal, drain, or any other plumbing effluent pipe. When the canister is activated to dispense the material substance, it will travel through the delivery tube 124 into the disposal, drain, or any other plumbing effluent pipe. A tube cap 130 is secured to the topside portion 132 of the top canister support member 108 to help secure the delivery tube 124 in its position. The tube cap 130 includes a channel that receives a portion of the delivery tube.

As illustrated, the body element 102 includes an aperture 134 for receiving a pipe adapter 136 that would be inserted between a pipe. When the apparatus 100 is used with a disposal the pipe adapter 136 is secured at one end to the disposal pipe and at the other end to the effluent from the dishwasher. The pipe adapter 136 is further designed to include a recessed slot 138 the receives a portion of the delivery tube 124 such that the second exit end 128 of the delivery tube 124 would be aligned with an end section 140 of the pipe adapter 136. When the end section 140 of the pipe adapter 136 is connected to another pipe, the second exit end 128 of the delivery tube 124 would be positioned within the other pipe, whereby a material substance can be injected right into the disposal, drain, or any other plumbing effluent pipe. A transition seal 142 or other rubber type gasket is fitted over the pipe adapter 136 and has a end portion 138 seated in the aperture 134 to help prevent leaks between the pipe adapter and the delivery tube.

To activate the dispersal of the material substance from the canister, an activation mechanism 150 is employed that when activated presses down on the valve opening of the canister. As is known in the art, the canister includes a valve opening that when pressed opens causes a release of internal pressure in the canister and thus a release of the material substance. When the valve opening is released the valve closes. With the delivery tube inserted into the valve opening, when the valve opening is pressed, the material substance will be released into and through the delivery tube and when eject out of the second exit opening of the delivery tube.

In one embodiment, the activation mechanism 150 includes a drive motor 152 engaged to drive a drive cam 154.

When the drive cam 154 rotates, it will vertically move a push rod 156. When moved vertically upwards the push rod 156 will move through a bore 158 defined in the lower canister support region 114. The upper end of the push rod 156 will contact and push a trigger button 160 upwardly, which engages and pushes the canister upwardly causing the valve opening to be pushed down by the first end 126 of the delivery tube 124, whereby the material substance is released.

In addition thereto, other elements may be provided such as a limit switch 162 and limit switch mounting block 164 which allows for only one rotation or activation of the canister per predetermined time limit. The predetermined time limit could be set by the factory or user set such as but not limited to every 12, 24 or 48 hours. Furthermore, the apparatus could include a manual activation button 175, that permits the user to activate the activation mechanism at any time.

The drive motor 152 can be positioned and secured to the apparatus by a motor mount 166 and include a motor connection cap 168 that secures a connection to the motor from a circuit board 170. The circuit board 170 would include the drive motor circuit and a timer control circuit to control the activation of the canister. The circuit board 170 would be positioned within a cover 172 and would be powered by a power jack 174. The power jack 174 would be electrically connected to a wall outlet or could be defined as a battery pack. The battery pack could be replaceable or rechargeable batteries.

Figure 4A:
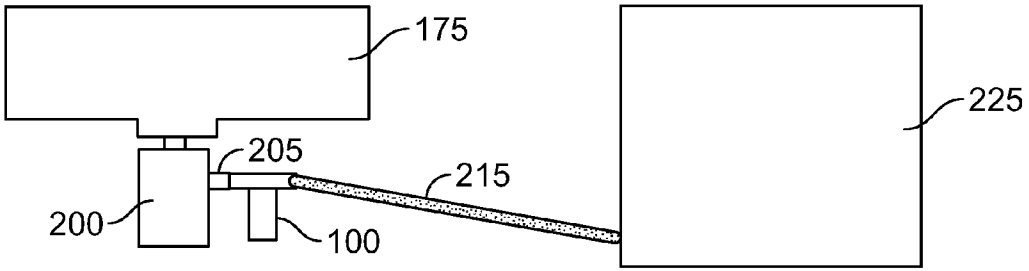
FIG. 4A is a block diagram showing one embodiment of the apparatus installed for use with a garbage disposal.
Figure 4B:
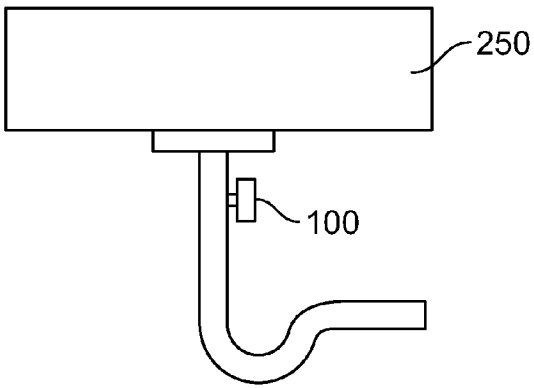
FIG. 4B is a block diagram showing one embodiment of the apparatus installed for use with a sink.

As illustrated in FIG. 4, one embodiment of the invention utilizes the apparatus 100 with a garbage disposal 200 that is positioned under a sink 175. The apparatus 100 would be positioned between the exit opening of the garbage disposal line 205 and the drain hose 215 from the dishwasher 225. When activated the material substance would be sprayed back through the garbage disposal line 205 and thus into the garbage disposal.

Figure 4C:
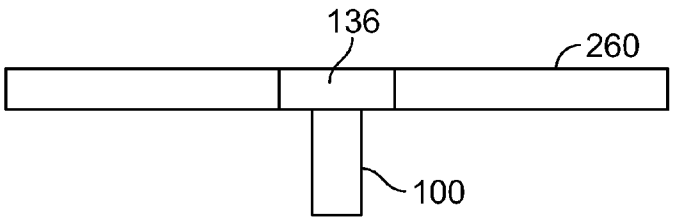
FIG. 4C is a block diagram showing one embodiment of the apparatus installed for use with a sewage pipe.

As noted other embodiments would include the use of the apparatus 100 in drains, toilets, sinks 250 (FIG. 4B) or any other plumbing effluent pipes 260 (FIG. 4C).

It should be further stated the specific information shown in the drawings but not specifically mentioned above may be ascertained and read into the specification by virtue of a simple study of the drawings. Moreover, the invention is also not necessarily limited by the drawings or the specification as structural and functional equivalents may be contemplated and incorporated into the invention without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. An apparatus for use with a canister having a chemical to disinfect and/or deodorize garbage disposals, drains, toilets, or plumbing effluent pipes, comprising:

a body element having an upper portion and a lower portion;

a top canister support member coupled to the upper portion of the body element and a base canister support member coupled to the lower portion of the body element, wherein the base canister support member is adjustable to support a canister between the top and base canister support members;

a pipe adapter which is bisected into a first and a second side by the body element, wherein the first side has a recess therein and is configured to be coupled to a garbage disposal, effluent pipe, or drain and the second side is configured to be coupled to an effluent water source;

a delivery tube that is coupled within the recess of the pipe adapter and has an entry end and an exit end, wherein the entry end is positioned for engagement with an opening defined by the canister used to release the chemical contained therein and a exit end that is aligned with an end of the first side of the pipe adapter; and;

an activation mechanism configured to activate the canister which is supported between the top and base canister support members to release the chemical contained within the canister into the delivery tube.

2. The apparatus of claim 1, wherein the activation mechanism includes a drive motor engaged to rotate a drive cam, the drive cam further engaged to move a push rod, said push rod having an first movement to cause a canister supported between the top and base canister support members to release a chemical contained within.

3. The apparatus of claim 1, wherein the activation mechanism includes a limit switch configured to permit a predetermined amount of activations within a specified time period.

4. The apparatus of claim 3 further comprising a circuit board having software configured to control the activation mechanism in accordance to the limit switch.

5. The apparatus of claim 4, wherein the circuit board further includes timing software configured to control the activation mechanism.

6. The apparatus of claim 1, wherein the upper canister support region includes inner and outer annular indentations to hold and support a top of a canister.

7. The apparatus of claim 1 further comprising a tube cap secured to a topside portion of the top canister support member above the tube to aid in securing the tube in position.

8. The apparatus of claim 1, wherein the power supply is a battery pack.

9. The apparatus of claim 1, wherein the base canister support member includes a slot sized to receive the lower portion of the body element for adjustment to support the canister.

10. The apparatus of claim 1 further comprising a transition seal that secures the pipe adapter to a garbage disposal, effluent pipe, or drain.

11. The apparatus of claim 10 wherein the outer circumference of the flow-through pipe is sized to fit inside and couple to a connecting pipe of the garbage disposal, effluent pipe, or drain.

12. An apparatus for use with a canister having a chemical to disinfect and/or deodorize garbage disposals, drains, toilets, or plumbing effluent pipes, comprising:

a body element having an upper portion and a lower portion;

a top canister support member coupled to the upper portion of the body element and a base canister support member coupled to the lower portion of the body element, wherein the base canister support member is adjustable to support a canister between the top and base canister support members;

a pipe adapter that is coupled to the upper portion of the body member and has a recess therein;

a delivery tube that is coupled to the top canister support member, the upper portion of the body member, and within the recess of the pipe adapter;

an activation mechanism configured to activate the canister to release a chemical contained within the canister into the delivery tube; and a transition seal that secures the pipe adapter to a garbage disposal, effluent pipe, or drain.

13. The apparatus of claim 12, wherein the activation mechanism includes a drive motor engaged to rotate a drive cam, the drive cam further engaged to move a push rod, said push rod having an first movement to cause a canister supported between the top and base canister support members to release a chemical contained within.

14. The apparatus of claim 12, wherein the power supply is a battery pack.

15. The apparatus of claim 12, wherein the base canister support member includes a slot sized to receive the lower portion of the body element for adjustment to support the canister.

16. The apparatus of claim 12, wherein the activation mechanism is further controlled by a manual activation button.

* * * * *